US005393222A

United States Patent [19]

Sutton

[11] Patent Number: 5,393,222

[45] Date of Patent: Feb. 28, 1995

[54] THERMOELECTRIC SENSOR

[75] Inventor: David M. Sutton, Camberley, United Kingdom

[73] Assignee: British Gas PLC, London, United Kingdom

[21] Appl. No.: 963,747

[22] Filed: Oct. 20, 1992

[51] Int. Cl.[6] ..... F23N 5/10; F23D 14/12

[52] U.S. Cl. ..... 431/80; 431/328

[58] Field of Search ..... 431/712, 75, 80, 170, 431/326, 328

[56] References Cited

U.S. PATENT DOCUMENTS

| | | | |
|---|---|---|---|
| 2,340,899 | 2/1944 | Ray | 431/80 X |
| 2,349,443 | 5/1944 | McCarty | 431/80 X |
| 2,407,517 | 9/1946 | Ray | 431/80 X |
| 2,501,627 | 3/1950 | Findley | 431/80 X |
| 2,519,241 | 8/1950 | Findley | 431/80 X |
| 3,224,485 | 12/1965 | Blomgren et al. . | |
| 4,480,986 | 11/1984 | Nelson et al. . | |

FOREIGN PATENT DOCUMENTS

| | | | |
|---|---|---|---|
| 2376366 | 7/1978 | France . | |
| 0142923 | 6/1987 | Japan | 431/80 |
| 0258928 | 11/1987 | Japan | 431/80 |
| 37685 | 9/1959 | Luxembourg . | |
| 1442745 | 7/1976 | United Kingdom . | |
| 2128776 | 5/1984 | United Kingdom . | |
| 2196459 | 4/1988 | United Kingdom . | |
| 2219388 | 12/1989 | United Kingdom . | |
| WO 86/05860 | 10/1986 | WIPO . | |

OTHER PUBLICATIONS

Patent Abstracts of Japan, vol. 11, No. 316 (M-631) (2763), Oct. 15, 1987, & JP-A-62 098 118, May 7, 1987, Hiroshi KODERA, "THERMOCOUPLE DEVICE".

Patent Abstracts of Japan, vol. 12, No. 286 (M-727) (3133), Aug. 5, 1988, & JP-A-63 061 817, Mar. 18, 1988, Kazumi Tanaka, "BURNER DEVICE".

*Primary Examiner*—Carl D. Price

*Attorney, Agent, or Firm*—Oblon, Spivak, McClelland, Maier & Neustadt

[57] ABSTRACT

A thermoelectric sensor assembly 1 for use with a flamestrip 9 in a fuel gas burner. The sensor assembly may be in the form of a probe 2 having temperature sensors 5*a,b,c,d* downstream of the flamestrip 9 in and adjacent the flame region, and temperature sensors 6*a,b,c* upstream of the flamestrip. A voltage output signal from the sensor assembly is used as an indication of the aeration of the flame and/or of flame establishment and/or flame failure and/or flame lightback.

26 Claims, 12 Drawing Sheets

| BURNER PORT LOADING = 4 W/MM$^2$ | | |
|---|---|---|
| AERATION (%) | MINIMUM PERMISSABLE PROBE OUTPUT VOLTAGE (MV) | MAXIMUM PERMISSABLE PROBE OUTPUT VOLTAGE (MV) |
| 110 | 183 | 187 |
| 120 | 178 | 182 |
| 130 | 173 | 177 |
| 140 | 165 | 171 |
| 150 | 152 | 162 |
| 160 | 139 | 151 |

*FIG. 16*

THERMOELECTRIC SENSOR

BACKGROUND OF THE INVENTION

1. Field of the Invention

The present invention relates to burner control and, more particularly, to a thermoelectric sensor and to a burner apparatus incorporating the thermoelectric-sensor.

Applicants are primarily interested in fully premixed air/fuel gas burner apparatus. By a fully premixed air/fuel gas burner apparatus Applicants mean one in which the fuel gas is mixed, prior to combustion, with all the air required for complete combustion, the combustion air being supplied by mechanical means and hereinafter referred to as "fan-means".

2. Description of the Related Art

A fully premixed air/fuel gas burner apparatus may employ a flamestrip which may be porous or have a plurality of burner ports or apertures therethrough, for example a ceramic flamestrip, to support the flame. The flamestrip may be a discrete part of the burner or, alternatively, may be integral with one or more other parts of the burner. In either case it is possible that the flame may be caused to burn very close to the flamestrip, for example when the flowrate of air in relation to the flowrate of fuel gas has, for whatever reason, decreased to about 10% in excess of that theoretically necessary for complete combustion, corresponding to an air/fuel gas mixture aeration of 110%. This can cause a rapid increase in burner temperature, particularly at low rates of heat output per unit of total flameport area (otherwise referred to as low port loadings). If this situation were allowed to persist, progressive overheating might occur and result in the flamefront entering the ports of the flamestrip and igniting the air/fuel gas mixture inside the burner. This dangerous condition is termed 'lightback'.

If an air/fuel gas mixture of high aeration, for example 160%, is supplied to the flamestrip, particularly at high port loadings, the velocity of the air/fuel gas mixture through the ports in the strip may become greater than the speed at which the flame can burn at the ports. The flame would then burn away from the flamestrip—a condition referred to as "flame lift". If the speed of the mixture is sufficiently greater than the flame speed, the flame front will be pushed or blown away from the flamestrip completely and the flame will disappear.

Furthermore, in combustion equipment it is generally the case that the position of the flame front varies with the rate of heat output at fixed aeration, the flamefront moving away from the flamestrip as the rate of heat output increases.

It will therefore be apparent that the position of the flamefront in fully-premixed combustion varies according both to the aeration of the air/fuel gas mixture and to the rate of heat output. In a system where the combustion air is supplied by fan means, in order to achieve a stable flame, means of controlling the rate of air supply (and so, the aeration) should, desirably always, be used, and must be used if the heat output of the burner is to be varied appreciably. In such a system, aeration control is most advantageously of the 'closed-loop' kind, comprising a variable-speed fan for supplying air, a modulating fuel gas valve, a means for measuring the air/fuel gas flowrate ratio and a control means to control the rates of air and fuel gas supply, so as to match these appropriately to each other by varying the fan speed and/or the fuel gas valve opening. The adoption of a 'closed-loop' aeration control system allows the operation of an appliance to be largely independent of the combustion characteristics of the fuel gas supplied, and also allows compensation as necessary for variations in the performance of the fan means, in supply voltage, and in the flow resistance of the flue and/or heat exchanger.

SUMMARY OF THE INVENTION

One object of the invention is to provide a thermoelectric sensing device for use in monitoring the operation of a fully premixed air/fuel gas burner apparatus.

Another object is to provide a fully premixed air/fuel gas burner apparatus incorporating the thermoelectric sensing device.

A further object of the invention is to provide a unitary combination of the thermoelectric sensing device and a flamestrip for use in fully premixed air/fuel gas burner apparatus.

Accordingly, from one aspect there is provided a thermoelectric sensing device for use in a fully premixed air/fuel gas burner apparatus comprising a flamestrip through which premixed air and fuel gas can pass for combustion in the vicinity of the intended downstream side of the flamestrip (having regard to the intended direction of flow of the premixture through the strip), the device comprising a plurality of temperature sensors which, when the device is located in position with respect to the flamestrip, are at different predetermined distances downstream of the upstream side of the flamestrip, the individual sensors being so dimensioned and spaced from each other as to be capable, when in use, of generating an aggregate output voltage which changes in a generally step-like manner as the flamefront of a flame supported by a flamestrip moves over the region occupied by the plurality of the sensors and successively across the sensors, with relatively large changes in the voltage output occurring as the flamefront crosses each sensor and with the voltage output remaining at different but relatively constant values as the flamefront moves across each region between successive sensors, and conducting means via which voltage output signals emanating from the sensors can be sensed.

From another aspect there is provided a fully premixed air/fuel gas burner apparatus comprising a flamestrip through which premixed air and fuel gas can pass for combustion in the vicinity of the intended downstream side of the flamestrip (having regard to the intended direction of flow of the premixture through the strip); a thermoelectric sensing device located in position with respect to the flamestrip, the device comprising a plurality of temperature sensors at different predetermined distances downstream of the upstream side of the flamestrip, the individual sensors being so dimensioned and spaced from each other as to be capable, when in use, of generating an aggregate voltage output which changes in a generally step-like manner as the flamefront of a flame supported by the flamestrip moves over the region occupied by the plurality of the sensors and successively across the sensors, with relatively large changes in the voltage output occurring as the flamefront crosses each sensor and with the voltage output remaining at different but relatively constant values as the flamefront moves across each region between successive sensors, conducting means via which voltage output signals emanating from the sensors can be sensed, and signal processing means responsive to the voltage output signals for controlling in a predetermined manner both fan means via which the air is supplied and gas valve means via which the fuel gas is supplied and thereby controlling in a predetermined manner the aeration of a flame supported by the flamestrip and/or for indicating flame establishment near the flamestrip and/or for indicating flame loss from the flamestrip.

From a further aspect there is provided a combination of a thermoelectric sensing device and a flamestrip for use in a fully premixed air/fuel gas burner apparatus, through which flamestrip, when in use, premixed air and fuel gas can pass for combustion in the vicinity of the intended downstream side of the flamestrip; and wherein the device is fixed or secured to the flamestrip and comprises a plurality of temperature sensors which are at different predetermined distances downstream of the upstream side of the flamestrip, the individual sensors being so dimensioned and spaced from each other as to be capable, when in use, of generating an aggregate voltage output which changes in a generally step-like manner as the flamefront of a flame supported by the flamestrip moves over the region occupied by the plurality of the sensors and successively across the sensors, with relatively large changes in the voltage output occurring as the flamefront crosses each sensor and with the voltage output remaining at different but relatively constant values as the flamefront moves across each region between successive sensors, and conducting means via which voltage output signals emanating from the sensors can be sensed.

In order to achieve the desired generally step-like changes in voltage output it is necessary to space the sensors sufficiently apart, in a direction transverse to the flow, so as to minimise the conduction of heat through the material between the sensors.

The relatively large generally step-like change in aggregate voltage output that occurs as the flamefront crosses a sensor is advantageous because the signal processing control means can be arranged not to respond to relatively minor changes in voltage output such as might be caused by minor disturbances in the flamefront.

In burner apparatus comprising this form of sensing device the signal processing means may be such as to ascertain when the output voltage from the temperature sensors departs from a predetermined value. For example, if partial lift off of the flame from the flamestrip occurs, so that the flamefront moves downstream away from a suitably positioned temperature sensor, a decrease in the aggregate output voltage will occur. When sufficient this decrease may be used to cause the control means to adjust the aeration at the flamestrip so as to restore the aggregate output of the sensing device to, or substantially to, the predetermined value.

When the device is located in position with respect to the flamestrip, one or more of the temperature sensors may be upstream of the downstream side of the flamestrip, so as to be within the flamestrip. Alternatively, all of the temperature sensors may be downstream of the downstream side of the flamestrip. In a different arrangement one of the temperature sensors may be substantially level with the downstream side.

Conveniently, the device also comprises at least one further temperature sensor for sensing temperature upstream of the flamestrip and conducting means via which voltage output signals emanating from the at least one further temperature sensor can be sensed. In this case signal processing means may be provided with the burner apparatus to be responsive to the voltage output signals emanating from the at least one further temperature sensor, for indicating flame lightback through the flamestrip. For example, the signal processing means may be connected to control means which, when such voltage output exceeds a predetermined value, operates to close a valve via which fuel gas is supplied to the flamestrip.

The temperature sensors and any further temperature sensors may each be in the form of discrete thermojunctions.

In one embodiment of the thermoelectric device, each temperature sensor is in the form of a discrete thermojunction to serve as an intended 'hot' junction, and the or each further sensor also is in the form of a discrete thermojunction to serve as one or more 'cold' junctions. The 'hot' and 'cold' junctions are electrically connected alternatively in series.

During operation of the burner apparatus including this embodiment of device the different 'hot' thermojunctions will be exposed to different and variable temperature at their various positions inside and outside of the reaction zone of the flame, whilst the or each 'cold' thermojunction upstream of the flamestrip will, normally, be exposed to a substantially single cooler temperature. All of the 'hot' thermojunctions may be downstream of the downstream side of the flamestrip.

With a given geometry of flamestrip and device, the output of the device will depend on the aeration and on the heat output per unit area of flamestrip. When the latter is known (e.g. from a measurement of the fuel gas flowrate) the aeration can be deduced. The thermoelectric device, as illustrated in more detail below, will provide (via the thermoelectric junctions) an output voltage signal which may be used in the monitoring and control of aeration in 'closed-loop' aeration control systems. The output voltage from the device may also be used to provide an indication of flame establishment and/or flame failure and/or lightback.

The device may be in the form of a probe. In this specification a probe is defined as a form of the device which is constructed and arranged so as to be removably mountable or locatable on a part of the burner apparatus, other than on the flamestrip, in a predetermined position with respect to the flamestrip with which it is intended to be used in the burner apparatus. For example, one end of the probe may be insertable through a dedicated opening or aperture in the flamestrip whilst the other end may be removably securable to, for example, a wall of a plenum chamber of the burner apparatus.

The device may, alternatively, be in a form intended to be permanently fixed to the flamestrip itself, for example by bonding means, to form a combination with the flamestrip. This form of device may extend across the thickness of the flamestrip, by extending through an aperture in the flamestrip or by extending across a peripheral edge of the flamestrip.

When the device, whether in the form of a probe or not, extends through an aperture in the flamestrip, the flamestrip, at least in part, may define one or more openings adjacent or immediately adjacent the outer surface of the device, such that when the burner is in use the or each opening serves to support a flame having a predetermined relationship to that supported by the remainder of the flamestrip.

By immediately adjacent the Applicants mean that the or each opening is defined between the outer surface of the device and the flamestrip.

By adjacent the Applicants mean that the or each opening is defined solely by the flamestrip, there being closer to the outer surface of the device no other ports, openings or other like apertures intended to support flame. The or each such adjacent opening may, but need not be, one of a plurality ports extending through the flamestrip for supporting flame on the flamestrip.

When the device is located in position with respect to the flamestrip, any temperature sensor downstream of the downstream face of the flamestrip may be shielded by a physical barrier from a direct line of sight to any source of radiant heat. Where the flamestrip fires into a combustion chamber having surfaces which are capable of emitting radiant heat, such as insulating surfaces, a non-heat radiating baffle wall may be provided between such surfaces and the temperature sensors. Where the flamestrip is a source of radiant heat associated with the burner apparatus, the physical barrier may shield any temperature sensor from a direct line of sight to the flamestrip at least. This reduces or minimises the exposure of the sensors to radiant heat. The significance of this is explained later. Physical barrier means may also be provided to shield each temperature sensor from a direct line of sight to the or each other temperature sensor. For example, the or each temperature sensor downstream of the downstream side of the flamestrip may be located within a, or a respective recess, provided in the device; thus the physical barrier is provided by a portion of the device in which the recess is formed.

The device may include a hollow cylindrical or prismatic portion which has a peripheral surface on which the temperature sensors are provided.

Alternatively, the device may, for example, have a planar surface on which the temperature sensors are provided. Conveniently, the device is of flat or planar form providing two planar surfaces, in which case all of the temperature sensors may be on the same planar surface.

Whether the device is in the form of a probe or not, the flamestrip may comprise a first flamestrip zone and a second flamestrip zone with the temperature sensors of the device being arranged so as to sense temperature emanating from a flamefront supported only by the first flamestrip zone. The first and second zones may be integral with each other or, alternatively, may be discrete first and second flamestrip parts, respectively. Such first and second parts may or may not be connected together. Where first and second flamestrip parts are provided, the thermoelectric device may be fixed to the first flamestrip part to form a combination. With this arrangement the first flamestrip zone is preferably used under conditions wherein there is no significant amount of heat radiation from the first flamestrip portion (i.e. under so-called non-radiating conditions) for reasons to be described later. The second flamestrip zone or zones may be used under either radiating or non-radiating conditions. The first flamestrip zone may have one or more ports therethrough via which the premixed air and fuel gas can pass for combustion.

BRIEF DESCRIPTION OF THE DRAWINGS

The invention will now be described, by way of example only, with reference to the accompanying drawings, in which:

FIG. 16 shows an example of a 'lookup table'.

DETAILED DESCRIPTION OF THE PREFERRED EMBODIMENTS

Figure 1:
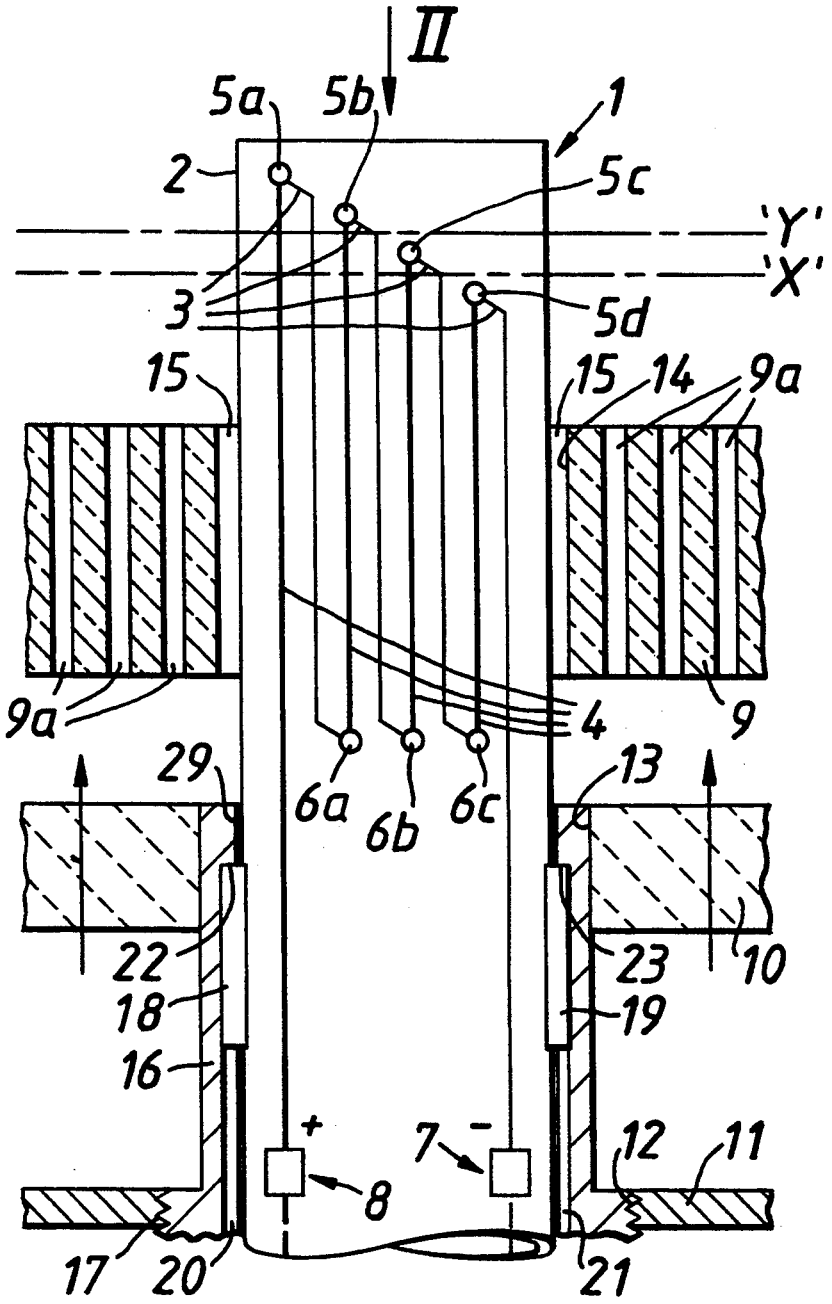
FIG. 1 shows in schematic form a thermoelectric device, in the form of a probe, according to the invention and its positioning with respect to a flamestrip in a burner apparatus.

With reference to FIG. 1, the thermoelectric probe 1 comprises a probe body 2, for example made in the form of a hollow ceramic rod which may be cylindrical (as shown) or prismatic and on the outside surface of which are printed tracks of alumel 3 and chromel 4, alternately, extending lengthwise of the rod. Although in this embodiment a chromel/alumel thermoelectric pair is described it will be appreciated that any other suitable thermoelectric pair may be used.

At predetermined positions the chromel and alumel tracks are joined together to form upper thermojunctions 5*a,b,c,d* (four in this particular example) at different distances from the tip of the probe and lower thermojunctions 6*a,b,c* (three in this particular example) all at substantially the same distance from the tip of the probe. The alumel track 3 from the thermojunction 5*d* and the chromel track 4 from the thermojunction 5*a* extend down the probe and are connected with electrical terminal regions 7,8, respectively, via which voltage output signals are passed from the probe as will be described later.

The tracks and thermojunctions may be overglazed for the purpose of providing better protection against corrosion.

The connection of the probe to the burner apparatus and its electrical connection to control means external to the probe will be described later.

The burner apparatus (of which only parts required for an understanding of the present embodiment are shown and described here) is of the fully premixed air/fuel gas burner kind and comprises a ceramic flamestrip 9 having a plurality of burner ports 9*a*, such as slots, extending therethrough and a permeable flametrap 10 spaced below the upstream face of the flamestrip. Below the flametrap is a wall 11 of a plenum chamber adapted for the supply of air/fuel gas mixture to the flamestrip.

The probe body 2 extends through substantially coaxially aligned apertures 12,13,14 in the plenum chamber, flametrap and flamestrip, respectively. The probe body is adapted and arranged to so extend through the aperture 14 in the flamestrip that the upper thermojunctions 5*a,b,c,d* are at different predetermined distances above the flamestrip 9 and the lower thermojunctions 6*a,b,c* are at substantially the same predetermined distance below the flamestrip.

Figure 2:
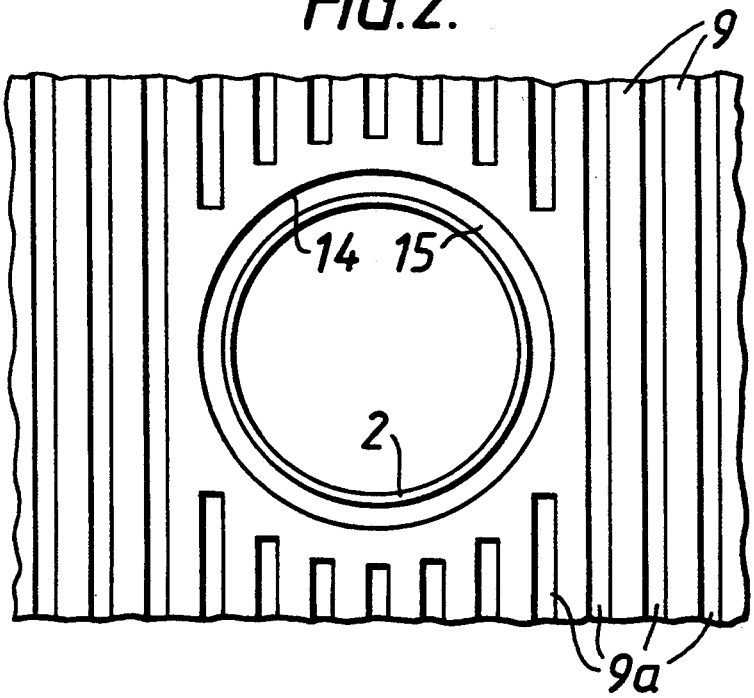
FIG. 2 is a plan view of the probe and flamestrip taken in the direction of arrow II in FIG. 1 with the thermojunctions and tracks omitted.

The geometry and dimensions of the aperture 14 in the flamestrip and of the probe body 2 are jointly such that the gap 15 between the surface of the flamestrip bounding the aperture and the exterior of the probe is of similar size to the actual normal ports 9*a* extending through the flamestrip as is also shown in FIG. 2. Thus the nature of the flames and flamefronts in the vicinity of the thermojunctions 5*a,b,c,d* is substantially the same as, or a close approximation of, the nature of those associated with the normal ports. Consequently, the flamestrip can be viewed as defining with the probe body 2 a dedicated port or aperture 15 for the thermoelectric probe 1.

An annular sleeve 16 made for example of ceramic material and having a cylindrical (as shown) or prismatic inner surface extends from the wall 11 of the plenum chamber only to the discharge side i.e. the upper side, as shown, of the flametrap and is in sealed contact with both the flametrap and plenum chamber.

Figure 4:
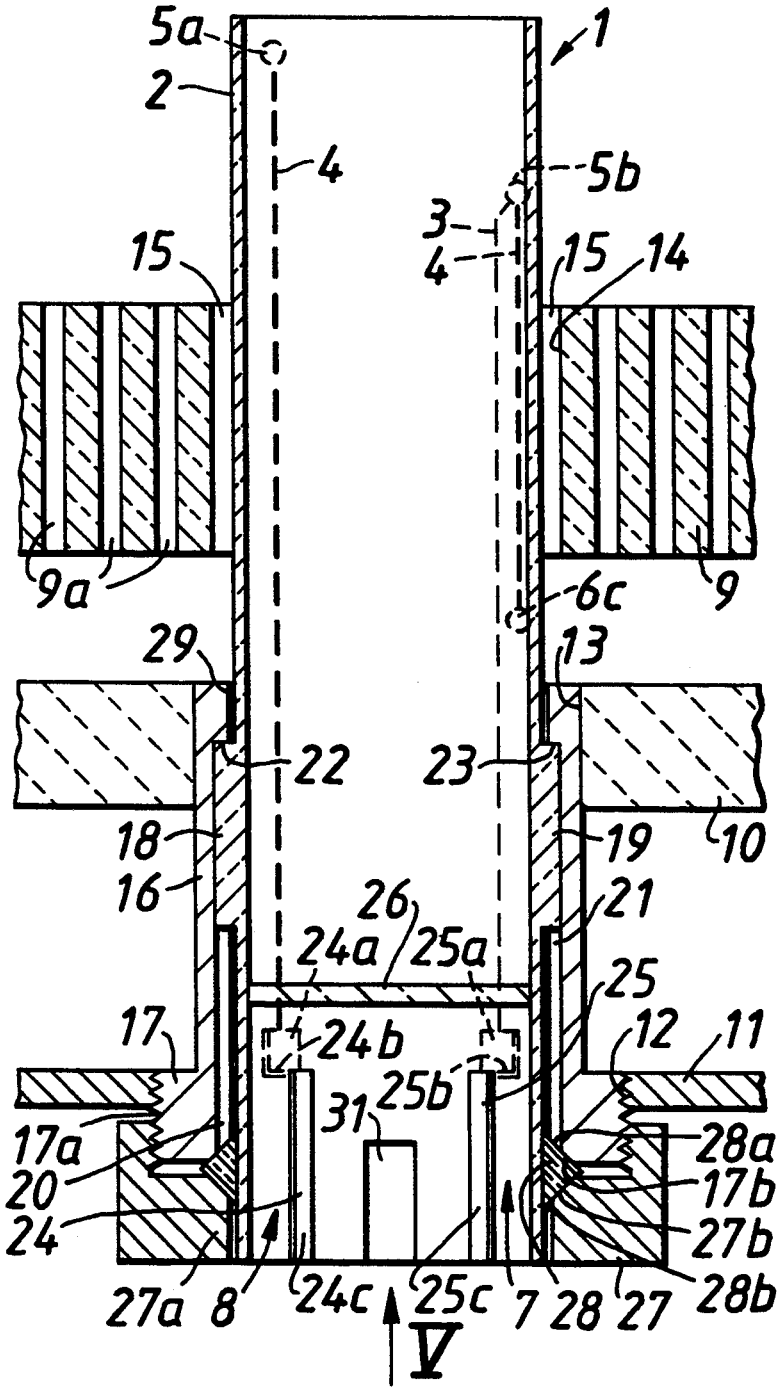
FIG. 4 is a cross-sectional view of the probe, taken on the line IV—IV through the length of the probe shown in FIG. 3, clamped in position by a securing ring with respect to a flamestrip and burner apparatus as shown in FIG. 1.

The lower end of the sleeve 16 is provided with an annular outwardly extending flange 17 having an external screw thread 17*a* (as shown in FIG. 4) via which the sleeve is screwed into the wall 11 in a manner such as to provide a seal to prevent leakage of the air/fuel gas mixture between the sleeve and the wall 11.

The outside surface of the probe body 2 is provided with two fixed, parallel formations or lugs 18,19 which extend outwardly and longitudinally of the surface of the probe body 2 and are located substantially diametrically opposite each other. The formations engage in respective channels, keyways or grooves, 20,21 in the sleeve 16. The channels 20,21 are open at their lower ends to permit insertion of the formations into the channels as the probe body 2 is slid through the hollow interior of the sleeve 16 into the burner apparatus. The channels terminate short of the upper end of the sleeve 16 so that the upper ends of formations 18,19 engage or abut against end surfaces 22,23 provided by the sleeve at the upper ends of the channels 20,21.

By locating the formations 18,19 in the channels 20,21 and furthermore against the end surfaces 22,23 of the sleeve it is ensured that the probe body 2 is positioned correctly in a rotational sense, should this be necessary or desired, and also at the correct depth of insertion in the burner apparatus so that the thermojunctions 5*a,b,c,d* and 6*a,b,c,* are at their predetermined positions with respect to the flamestrip.

The engagement of the formations 18,19 with the channels 20,21 also determines the lateral positioning of the probe body 2 within the sleeve 16, in a plane parallel with, for example, the flamestrip 9. This positioning is such that the gap 15 which encircles the probe body is substantially as desired throughout the depth of the flamestrip.

Figure 5:
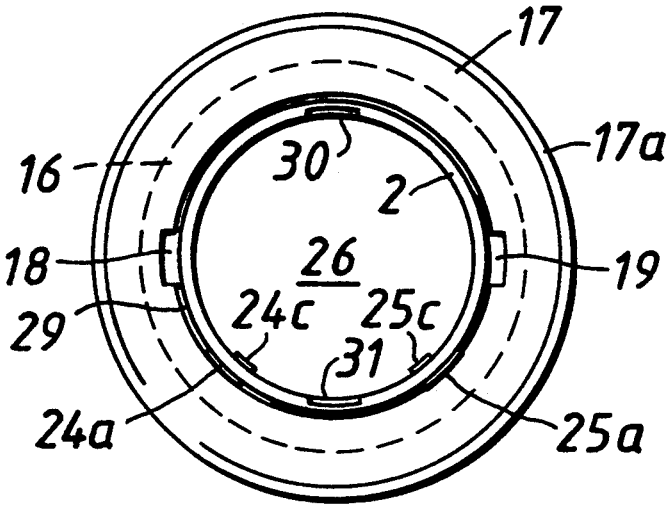
FIG. 5 is an end view of the probe and surrounding sleeve taken in the direction of arrow V in FIG. 4, but with the ring seal and securing ring omitted.
Figure 3:
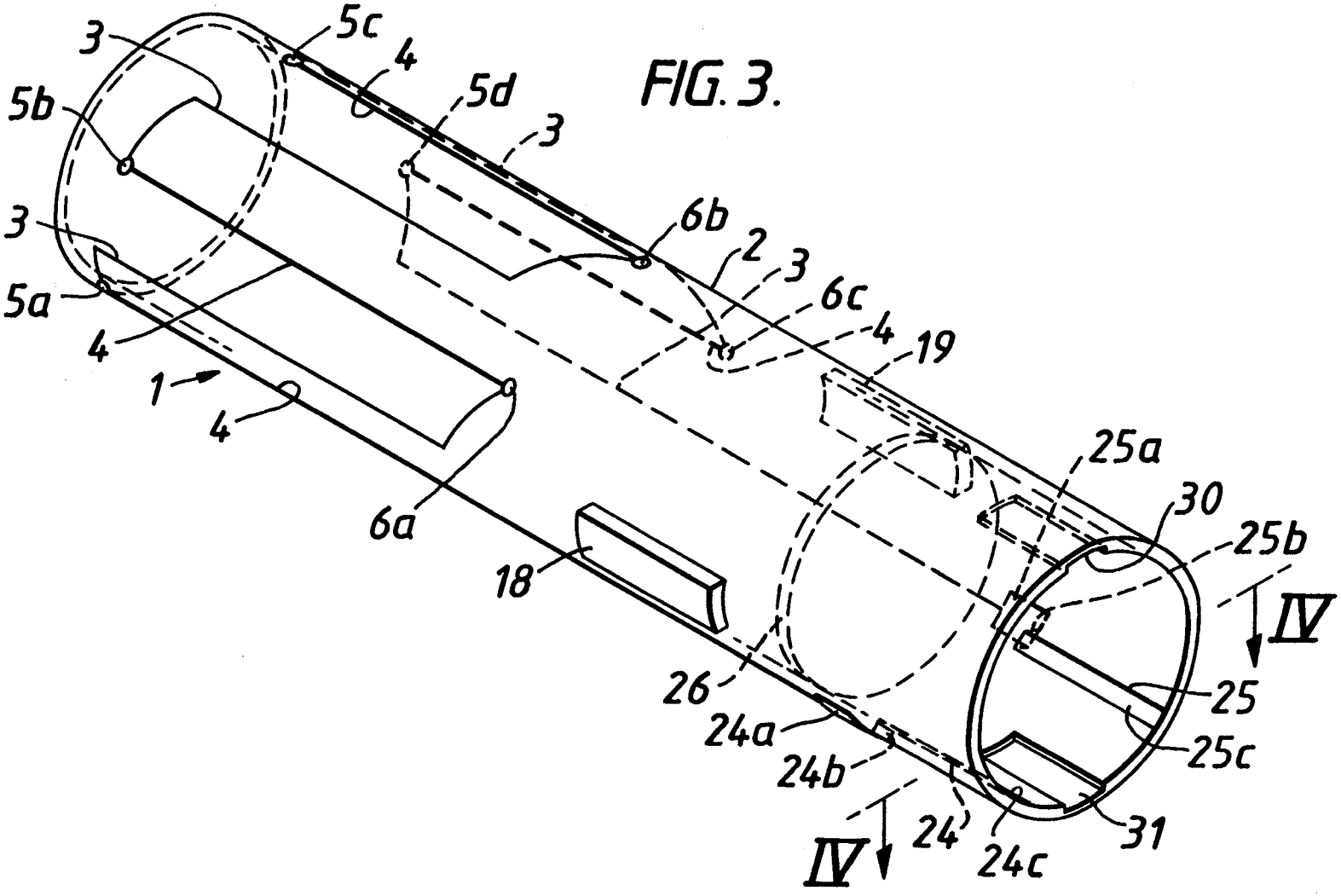
FIG. 3 is a perspective view of one embodiment of thermoelectric probe according to the invention.

One form which the probe may take in practice is shown in FIGS. 3,4 and 5. With reference to those figures parts similar to those described with reference to FIG. 1 have been designated the same reference numbers and will not be described again, to avoid repetition, unless further explanation or clarification is felt necessary.

In FIGS. 3, 4 and 5, the probe body 2 is in the form of a straight, thin-walled hollow ceramic rod having a low thermal capacity. At each of the terminal regions 7 and 8 as shown in FIG. 4, metal strips 24,25 are electrically connected to the lower ends of the tracks 3 and 4, respectively, to provide electrical terminals to enable the probe to be connected to control means as will be described later. Each metal strip 24,25 comprises a portion 24*a*,25*a* overlying and connected, for example by a metal/metal bond, to the respective lower end of the tracks 3,4 on the outside of the probe body, an intermediate portion 24*b*,25*b* which extends in a sealed manner through a respective aperture (not shown) in the wall of the probe body 2, and a portion 24*c*,25*c* which extends down the inside of the wall of the hollow probe body towards the bottom end of the probe body as viewed in FIG. 4.

Above the terminal portions 24*a*,25*a* the probe body 2 is provided with an internal blanking-off plug 26. Should the burner apparatus fire into a region in which the pressure differs from the pressure in the space below the wall 11 as viewed in FIG. 4 the blanking-off plug 26 will serve to prevent leakage, via the interior of the probe body 2 between the region and the space. As shown in FIG. 4, the plug 26 may be so located in the probe as to be in the zone between the plenum wall 11 and the flametrap 10 when the probe body is mounted in position.

Relative to the flamestrip 9, the probe is secured in position on the wall 11 of the plenum chamber by means of an internally screw threaded securing ring 27 having an annular internal flange 27*a*. The ring 27 screws onto the externally threaded flange 17 of the sleeve 16. A ring seal 18 of triangular cross-section (as seen in FIG. 4) encircles the probe body 2 and is compressed between the flange 17 of the sleeve 16 and the flange 27*a* of the securing ring 27 to provide a seal which closes off the annular gap 29 between the probe body 2 and the sleeve 16 at the lower end of the sleeve. The surface of the flange 17 of the sleeve 16 and the surface of the flange 27*a* of the securing ring 27 incorporate conical seatings 17*b* and 27*b* which engage and match respectively with the surfaces; 28*a*,28*b* of the ring seal 28, as can be seen in FIG. 4. If necessary or when desired, the probe can, after unscrewing the securing ring 27, be withdrawn from the burner apparatus through the sleeve and be replaced readily without dismantling the burner apparatus.

It will be appreciated that an electrical plug (not shown) carrying terminal conducting portions for engaging the terminal conducting portions 24*c*,25*c* on the probe body 2 may be inserted into the lower end of the probe body to connect with external electrical equipment. The bottom end of the probe body may be provided with one or, as shown, two recesses 30,31 in its internal surface to receive a lug or lugs (not shown and as appropriate) on the external surface of the electrical plug, to facilitate correct positioning of the plug with respect to the terminal conducting portions 24*c*,25*c* on the probe body.

The positioning and configuration of the thermojunctions 5*a,b,c,d* are predetermined having regard to the burner apparatus and flame strip with which the probe is intended to be used. Prior experiments and investigations will have been conducted to correlate, for any given configuration of the thermojunctions 5*a,b,c,d*, the magnitude of the aggregate voltage output signal from the probe 1 with the port loadings (i.e. heat output rates) and the aerations used to produce the results. Such data can be presented in the form of a graph as shown in FIG. 6.

Figure 6:
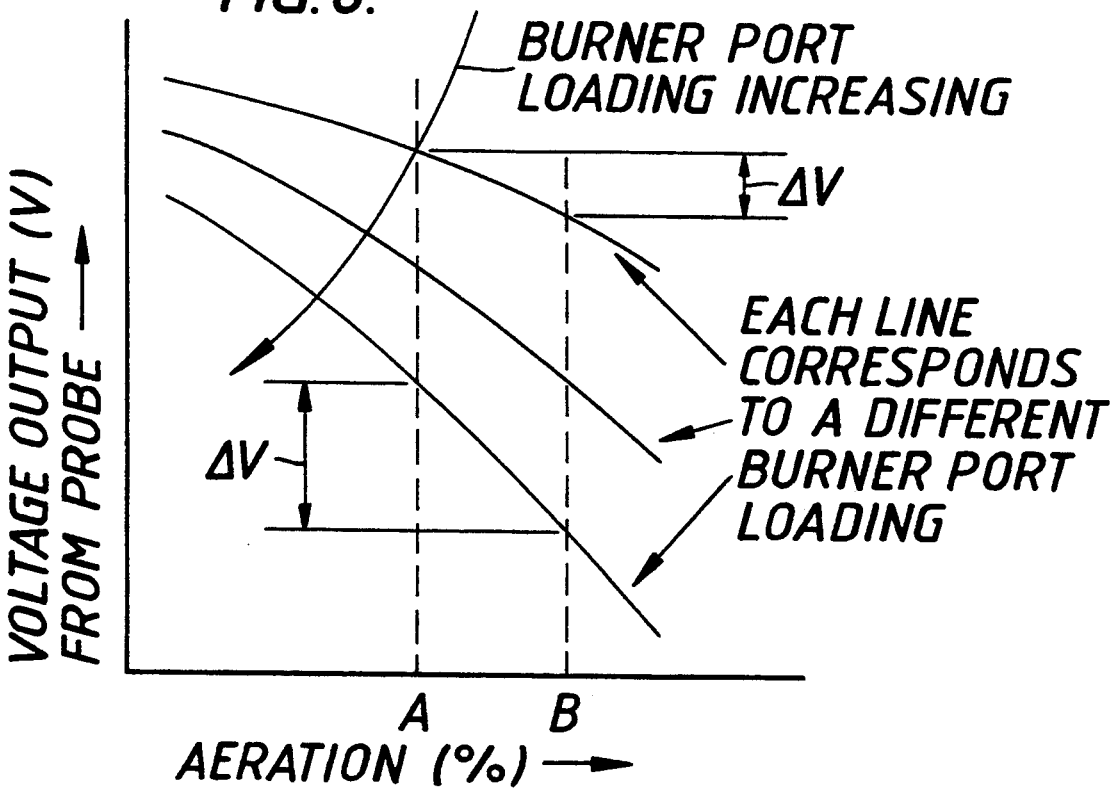
FIG. 6 shows in idealised form by way of illustration a graph in which voltage output from the thermoelectric device is plotted against aeration for different heat outputs per unit area of flamestrip.

To illustrate the basis of FIG. 6, let it be assumed that the burner is operating at some particular rate of heat output and at the desired aeration with the flame in a substantially stable state, the flamefront being at, say, position 'X' in FIG. 1. The thermojunctions 5*a,b,c* are downstream of the flamefront and relatively hot compared with the thermojunction 5*d*, whilst all of the thermojunctions 6*a,b,c* are relatively cold compared with the thermojunctions 5*a,b,c,d*. (All of the downstream junctions 5*a,b,c,d* are designated 'hot' junctions and the upstream junctions 6*a,b,c* are designated the 'cold' junctions). With the flamefront at position 'X' the aggregate output voltage from the probe will be of a particular magnitude dependent upon the aeration of the air/fuel gas mixture supplied to the burner. This can be shown as a point on a performance diagram such as FIG. 6, note being also taken of the aeration and of the burner port loading corresponding to the rate of heat output assumed.

If, in response to a change in the external demand for heat, the rate of burner heat output is altered, the position of the flamefront, relative to the probe will generally alter. For example, if the burner is caused to operate at a higher rate of heat output, while the aeration is maintained unchanged, the flamefront may move to the position 'Y' in FIG. 1. In this case Only the thermojunctions 5*a,b* will be downstream of the flamefront and relatively hot compared with the thermojunctions 5*c,d*. It will therefore be apparent that with the flamefront at 'Y' the aggregate output voltage from the probe will be different from (in practice, lower than) the aggregate output voltage delivered with the flamefront at 'X'; and this could be portrayed as another point on a diagram such as FIG. 6.

Were the flamefront to move successively across the thermojunctions 5*a,b,c,d*, an aggregate output voltage which changes in a generally step-like manner would be produced since relatively large changes in aggregate voltage output would occur as the flamefront crosses each thermojunction whilst the aggregate voltage output would remain at a relatively constant value as the flamefront moves across the region between successive thermojunctions.

Furthermore, should there occur a change in the aeration of the air/fuel gas mixture, the heat output rate of the burner remaining unchanged, the temperature of the products of combustion will in the general case alter, for example decreasing with increasing aeration. As a result, each of the thermojunctions downstream of the flamefront will produce an individual output voltage, and the device as a whole an aggregate output voltage, different from before. Once again this effect can be depicted in a diagram such as FIG. 6. For example, on the lowest curve in FIG. 6, the output voltage of the device will change over a range $\Delta V$ as the aeration of the air/fuel gas mixture changes from A% to B%.

It will be appreciated that, once produced for a given device/flamestrip/burner apparatus in combination, FIG. 6 can be used in a reverse sense as a 'lookup table' or data bank, to deduce the aeration which is implied by some particular value of aggregate output voltage at some particular rate of heat output (burner port loading). It will also be appreciated that it is possible to specify, at any particular port loading, acceptable limits of deviation of the aeration from some desired or ideal value, in terms of permissible upper and lower limits of aggregate output voltage, at that port loading. It should also be appreciated that FIG. 6 is not unique. For example, should the burner fire into an enclosure or chamber the relationship between the aggregate output voltage from the device 1, the aeration and the burner port loading may be altered. Any such alteration would arise from radiant heat exchange between bounding surfaces of the enclosure or chamber and the thermoelectric device.

Figure 7:
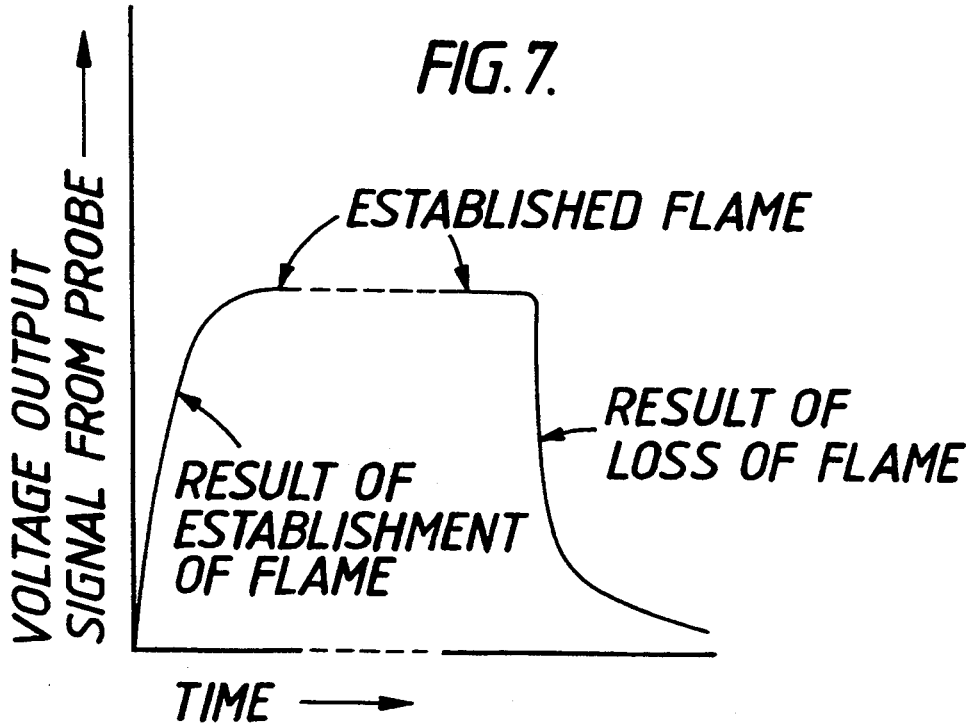
FIG. 7 shows in idealised form by way of illustration a graph in which voltage output from the device is plotted against time to portray, successively, the flame at the flamestrip appearing, remaining stable and then disappearing suddenly.

FIG. 7 shows the aggregate output voltage plotted against time. This Figure highlights the rapid rate at which this voltage rises as the flame becomes established in a substantially stable or settled state, and the rapid rate at which the voltage falls when the flame becomes extinguished. The control system may be provided with signal processing means comprising, on one hand, processing means for detecting a rapid positive rate of change in aggregate output voltage from the device 1 as evidence of flame establishment and, on the other hand, processing means for detecting a rapid negative rate of change in aggregate output voltage as evidence of flame loss. The rise or fall in output voltage depicted in FIG. 7 would be substantially completed within a period of a few seconds, typically 5 seconds, by reason of the low thermal capacity of the device.

If the burner apparatus malfunctions and lightback occurs with the flame burning immediately upstream of the flamestrip 9, the thermojunctions 6*a,b,c* will become relatively hotter than the thermojunctions 5*a,b,c,d* since the former will now be the junctions more directly exposed to the heat of the flame. Consequently the polarity of the aggregate voltage output from the device will become reversed. The control system may include signal processing means to detect such a reversal of output voltage polarity as evidence of flame lightback.

Figure 8:
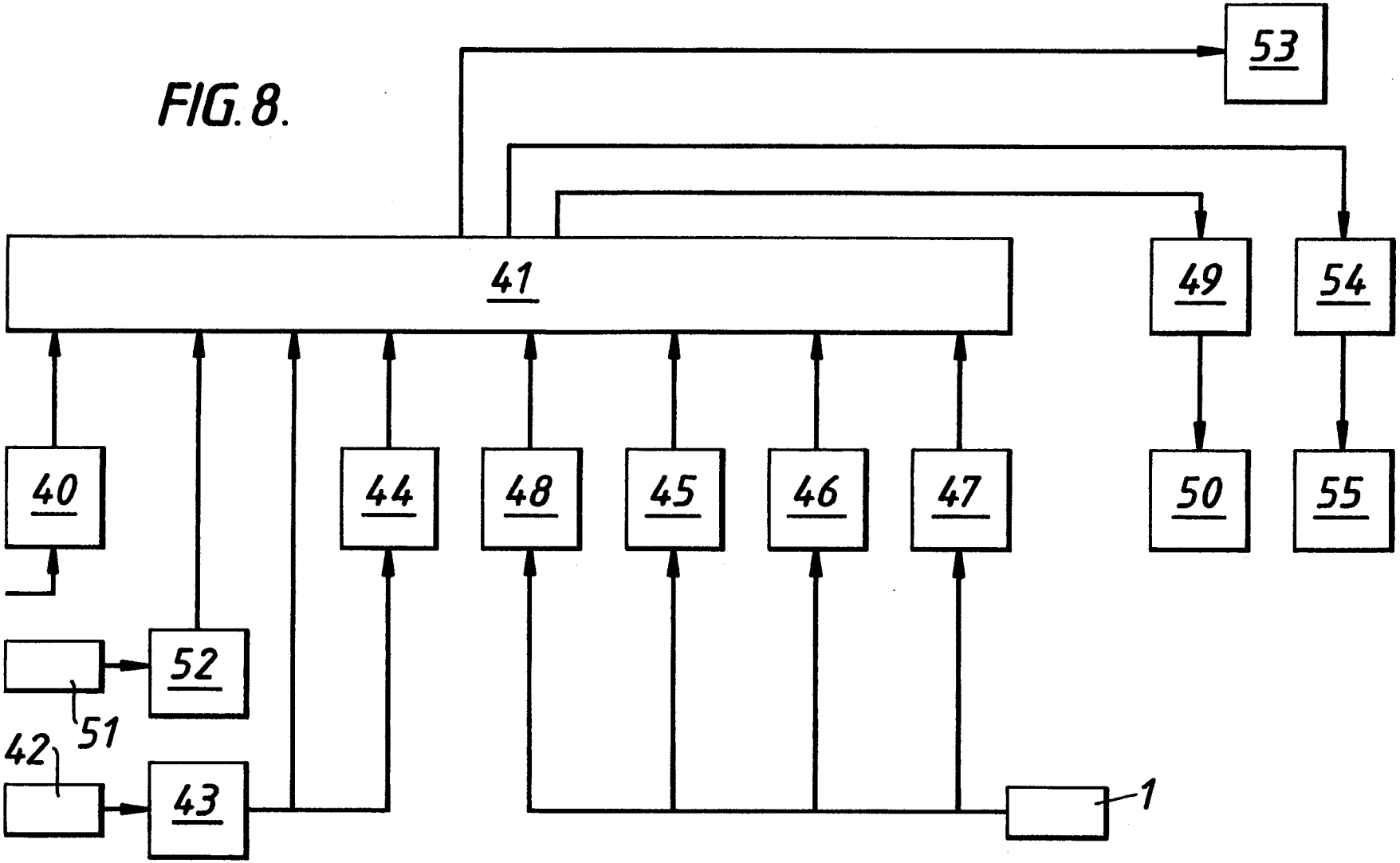
FIG. 8 is a schematic illustration of components of a control system for utilising the voltage output signal from a device according to the invention.

Reference will now be made to FIG. 8, purely to illustrate the different functions of the thermoelectric device, and to show broadly how they may be utilised to control the operation of burner apparatus, for example in a boiler for providing central heating and/or a sanitary hot water service.

When there arises a demand for some particular rate of heat output from the boiler, this is signalled from a load-indicating heat output demand source (not shown) to an interfacing signal processing means 40. This latter then provides (for example, in accordance with an internally-stored 'lookup table') an output signal representative of the gas flowrate necessary to supply the rate of heat output demanded. This signal is delivered to a first input of a comprehensive central signal processing means 41.

The actual gas flowrate existing is measured by a gas flowrate detecting means 42 and reported to an interfacing signal processing means 43. The output signal from the means 43, representative of the actual gas flowrate existing, is delivered both to a second input of the comprehensive means 41 and to a signal processing means 44, the function of which will be described subsequently.

The voltage output from the probe 1 is delivered in parallel to signal processing means 45,46,47,48. The means 45,46 are, as mentioned above in relation to FIG. 7, respectively, the means for detecting:

(i) a rapid positive rate of change in aggregate output voltage, indicative of flame establishment, and (ii) a rapid negative rate of change in aggregate output voltage, indicative of flame loss.

The means 47 is a means for detecting the polarity and magnitude of the output voltage from the device. Given that the means 45 has detected a rapid positive rate of change in the aggregate output voltage from the device 1 and furthermore that the means 46 has not subsequently detected a rapid negative rate of change in this voltage, it will be apparent that in the light of the description given above regarding the functioning of the device 1, a positive value of the aggregate output voltage of at least some predetermined magnitude will be indicative of the continued presence of a flame on the flamestrip 9 of the burner apparatus; and that a negative value of the aggregate output voltage will be indicative of flame lightback.

It will therefore be seen that each of the means 45,46,47 delivers an output signal to a respective input of the comprehensive signal processing means 41, to inform the means 41 of the detection of flame establishment, flame loss, standing flame presence or flame lightback, as the case may be.

The signal processing means 48 is associated with regulation of the aeration of the air/fuel gas mixture, as will be described subsequently.

The action taken by the means 41 upon initial receipt of a signal from the means 40 depends upon whether or not the signal from the means 43 differs from some predetermined value signifying, on the basis of the signal from the means 42, that the burner apparatus has not yet been put into operation.

If the signal from the means 43 implies that the burner apparatus is not operating, the processing means 41 will output a signal to an air flowrate control means 49 regulating the rotational speed of a variable-speed combustion air fan 50, so that the fan 50 will commence rotation. The air flowrate delivered by the fan 50 is measured by an air flowrate detecting means 51 and reported via an interfacing signal processing means 52 to the means 41. The means 41 will, if necessary, subsequently output further signals to the means 49 until the speed of the fan 50 has become sufficient to deliver an air flowrate substantially equal to a predetermined value appropriate to safe starting of the burner apparatus. When this air flowrate has persisted for a predetermined period of time (registered, for example, by a timer means internal to the means 41 and referred to as the 'pre-purge time') the means 41 will output a signal to bring into action an ignition means 53. After a further predetermined period of time (again registered, for example, by a timer means internal to the means 41, this timer means not necessarily being separate from that for registration of time during the purging operation), the means 41 will output a signal to a gas flowrate control means 54 regulating the degree of opening of a modulating gas valve 55, such that there results a gas flowrate substantially equal to a predetermined gas flowrate and conducive, with the abovementioned airflow, to satisfactory operation of the burner apparatus.

If the means 41 then receives from the means 45 a signal indicative of flame establishment, this signal being received within a predetermined period of time referred to as the 'ignition safety time' (and registered, for example, by a timer means internal to the means 41), the means 41 will output a signal to deactivate the ignition means 53. If, however, the means 41 receives no signal from the means 45 within the 'ignition safety time', the means 41 will output both a signal to the gas flowrate control means 54 so as to cause complete closure of the gas valve 55, and a signal to deactivate the ignition means 53. Furthermore, after a predetermined period of time which may be substantially equal to the 'purge time', and which may be registered for example, by a timer means internal to the means 41, the means 41 will output a signal to the air flowrate control means 49 so as to cause the fan 50 to be deactivated and brought to rest. In addition, the means 41 will initiate within itself a condition termed 'lockout', whereby further operation of the central signal processing means 41 is debarred until a user removes 'lockout', for example by temporarily interrupting the electrical supply to the control system.

If, following a successful establishment of flame at the flame strip 9, an accidental loss of flame should suddenly occur for some reason, the signal processing means 46 will output a signal to the means 41. This latter will, in turn, output a signal to the gas flowrate control means 54 to cause complete closure of the gas valve 55, and if necessary a signal to the air flowrate control means 49 to cause the speed of the fan 50 to be reduced until the air flowrate becomes substantially equal to the predetermined value described previously. This being achieved (as evidenced by the signal from the means 52) the comprehensive processing means 41 will initiate a startup sequence, as described above. Should a flame either fail to result, or once again be lost after being established, the means 41 will initiate a 'lockout' condition within itself.

Again, if, following a successful establishment of flame at the flamestrip, the flame should at some moment light back into the burner, this will be detected by the voltage polarity responsive means 47 as described earlier, and a signal will be output to the means 41. The latter will then output a signal to the gas flowrate control means 54 to cause complete closure of the valve 55. After a period of time which may be substantially equal to the 'purge time'0 employed during startup of the burner apparatus and which is registered, for example, by a timer means internal to the means 41, the means 41 will output a signal to the air flowrate control means 49 to cause the fan 50 to be deactivated. In addition, the means 41 will initiate a 'lockout' condition within itself.

Given that a flame is established successfully and that thereafter it continues to exist in a normal manner at the flamestrip, if any difference between the signals supplied to the comprehensive signal processing means 41 from the means 40,43 were to exceed a predetermined magnitude this would indicate an unacceptable degree of inequality between the demanded rate of heat output and the delivered rate of heat output. In case of such eventuality then the means 41 will output separate signals to the air flowrate control means 49 regulating the rotational speed of the variable-speed combustion air fan 50, and to the gas flowrate controlling means 54 regulating the degree of opening of the modulating gas valve 55. In response to the signals from the means 41, the outputs from the flow control means 49,54 may be arranged to alter so as ultimately to return the difference in the signals from 40 and 43 to within the permitted range of inequality. This is performed in a manner such that the flowrates of air and fuel gas alter at predetermined relative rates, the ratio between these flowrates (and so, the aeration) being intended to remain at all times within a band having predetermined upper and lower limits, as mentioned above. Furthermore, should it prove advantageous, the band of permissible aeration values may be made dependent upon the rate of gas flow. For example, at high gas flowrates, aeration values in a band covering relatively lower values of magnitude may be prescribed, for instance to increase the thermal efficiency of an associated heating appliance or to lessen the size and cost of the combustion air fan. Conversely, at low gas flowrates, aeration values in a band covering relatively higher values of magnitude may be prescribed, for example to provide an increased margin of safety against flame lightback.

Again, for reasons of safety, the control means 49,54 may be arranged such that when the rate of heat output is to be increased, the air flowrate is increased slightly in advance of the gas flowrate; and conversely when the heat output is to be reduced, the air flowrate is decreased slightly later than the gas flowrate. In this case, during the process of heat output alteration, the aeration value would tend towards the upper end of the band of permissible values.

Should the signal from the means 40 indicate that the demand for heat output has ceased, the means 41 will output a signal to the gas flowrate control means 54 to cause complete closure of the valve 55; and after a predetermined time registered, for example, by a timer means internal to the means 41, the means 41 will output a signal to the air flowrate control means 49 to cause the fan 50 to be deactivated.

The means 40 may be arranged to cause a continuous demand for heat output to be signalled to the means 41 as an intermittent or cyclic requirement for the burner apparatus to be brought into operation. This feature of the means 40 would be especially advantageous should the demand for heat output be less than the lowest heat output available from the burner apparatus in continuous operation.

The arrangement so far described in relation to FIG. 8 provides aeration control of the 'open-loop' kind. However with that form of control the aeration may tend to depart from the intended range of values, for example, when there is a variation from the normal performance of the fan or when there is a change in the flow resistance of the flue. In such cases the use of Applicant's device is particularly advantageous, as in effect it transforms the aeration control method from the 'open-loop' kind to the 'closed-loop' kind, as mentioned earlier and as will now be described.

The interfacing signal processing means 48 outputs to the means 41 a signal representative of the aggregate output voltage of the probe 1. A further input signal to the means 41 is provided by the signal processing means 44. This second signal is representative of the permissible upper and lower limits of the probe output voltage, as established by the means 44 (for example, from an internally-stored 'lookup table' or data bank) in dependence upon a signal from the means 43, this signal being representative of the actual gas flowrate existing. FIG. 16 shows one example of a 'lookup table'. It will be appreciated that a series of similar 'lookup tables' will be stored in memory in respect of a range of different burner port loading values (X). Should the aggregate output voltage lie outside the permissible limits, the means 41 would output a correcting signal, in the first instance to the air flowrate control means 49 only. This latter would then cause the variable-speed fan 50 to increase or to decrease, as appropriate, the flowrate of the combustion air, so as to return the ratio of the air flowrate to the gas flowrate (i.e. the aeration) to the range intended. However, should such alteration of the air flowrate prove unable, because of adverse circumstances, fully to provide the required correction to the aeration, the means 41 would then output a correcting signal to the gas flowrate control means 54, the effect of this signal being converse to that supplied by the means 41 to the air flowrate control means 49. Consequently the modulating gas valve 55 would decrease or increase, as appropriate, the flowrate of fuel gas sufficiently to allow the aeration to return to a value within the intended range.

It will be appreciated, therefore, that the probe 1 can be employed for the monitoring and control of aeration in 'closed-loop' aeration control systems.

In the interests of simplicity the foregoing description has omitted reference to certain routine details relating to safety which would need to be taken into account in practice. The description relating to FIG. 8 is intended solely to illustrate the control features made possible by use of the probe 1.

When operating conditions are transient, the output of the probe will differ from the output which would be observed in steady-state operation at the same burner port loading and aeration. For instance, when the rate of heat output is increasing, the output voltage from the probe will be higher than would be expected from FIG. 6. Such difference (or 'lag') will be greatest when the rate of heat output is changing rapidly. Discrepancies of this type can be minimised by minimising the thermal capacity of the probe and maximising (subject to considerations of shielding from radiant heat, as will be described later) the exposure of the 'hot' thermojunctions to the combustion products. The construction of the probe seeks to facilitate the achievement of these objectives within constraining considerations such as the strength and reliability of the probe. However since, in practice, the output of a real probe will show some degree of response lag, it is necessary to control the rate of change of burner heat output so that the aggregate output voltage will not stray, purely due to lag, beyond the band limits specified in the 'lookup table'.

It will be evident from the above description of the probe illustrated schematically in FIG. 1 and from the description of the control system in FIG. 8 that the probe may be used in a multifunctional manner. Thus, the output voltage signal from the probe can be utilised to monitor simultaneously the aeration of the air/fuel gas mixture, the establishment/failure of the flame, and the absence/existence of light-back. It will be appreciated that the voltage signal from the probe can be processed, and responded to, by microelectronic means or otherwise.

In an ideal arrangement the thermojunctions would sense heat from the combustion products by convection only. However, in practice the thermojunctions 5*a,b,c,d* will also be sensitive to radiant heat emanating from various surfaces in their vicinity, for example, from the downstream side (i.e. upper side as viewed in the drawings) of the flamestrip or from refractory combustion chamber linings (not shown). If a significant amount of radiant heat reaches a thermojunction in relation to the combined total of convective heat and radiant heat, the burner aeration will not in general be adequately monitored. An indication of the effect of radiant heat may be deduced from FIG. 6 in that the slope of the characteristic lines therein decreases with decreasing port loading. This occurs partly because the flamestrip temperature increases as the port loading decreases at fixed aeration. A low slope of the characteristic line for a given port loading implies that the aggregate voltage output of the probe will be relatively insensitive to changes in the aeration.

Thus, as can be seen from FIG. 6, the range $\Delta V$ over which the voltage output varies between two different values of aeration, for example A and B, is greater at the higher port loadings than at the lower port loadings. Viewed another way, the sensitivity of the probe increases with an increase in port loading for a given aeration.

In order to reduce or minimise the exposure of the 'hot' thermojunctions 5*a,b,c,d* to radiant heat the probe may be so constructed that a respective physical barrier is present directly between each thermojunction and the source of the radiant heat. For example, the thermojunctions 5*a,b,c,d* may be located within grooves or recesses provided around the outer surface of the probe. Alternatively, the probe may have successive portions of decreasing radius arranged step-wise in the direction away from the flamestrip, to form annular recesses having shoulders or surfaces on which the thermojunctions 5*a,b,c,d* may be located.

Additionally, should the flamestrip associated with the device fire into a combustion chamber, this chamber should, in the line of sight of the thermojunctions, most advantageously, not have surfaces capable of emitting radiant heat, such as insulating linings. For example, surfaces in the line of sight of the thermojunctions should be low temperature, cooled surfaces, such as suitable water cooled surfaces.

Figure 11:
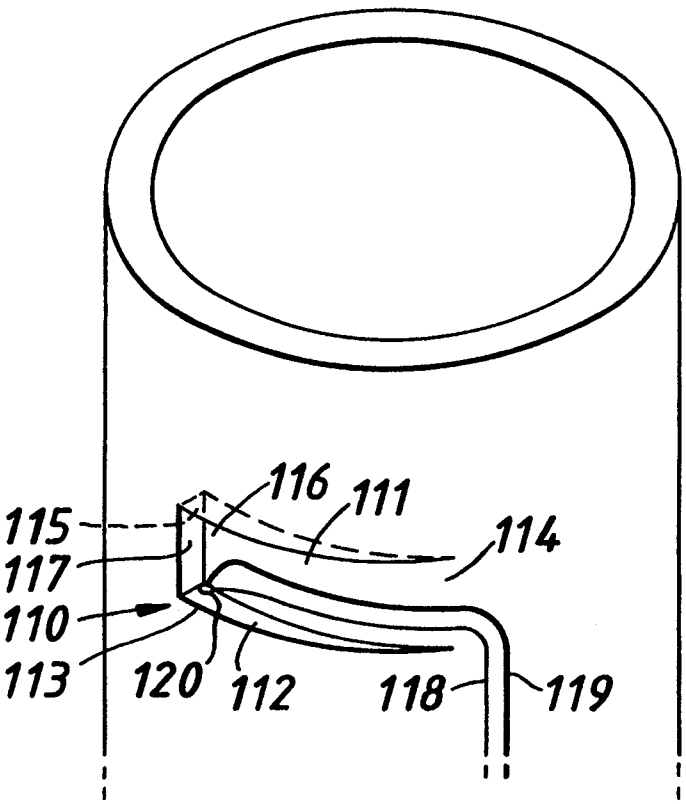
FIG. 11 shows in schematic form a portion of a further embodiment of device according to the invention.
Figure 9:
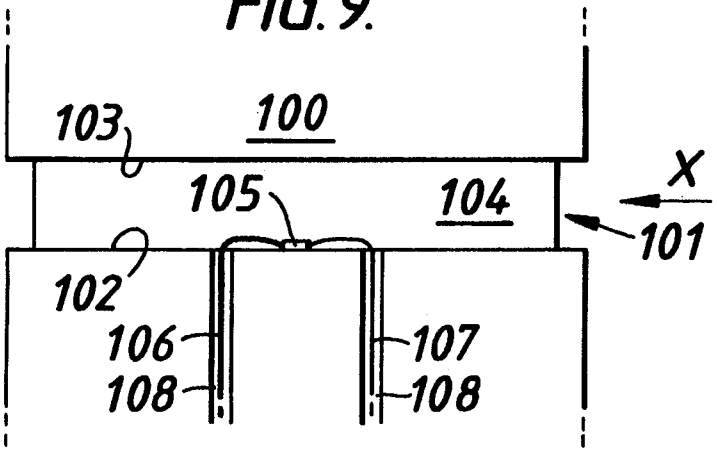
FIG. 9 shows in schematic form a portion of another embodiment of device according to the invention.
Figure 10:
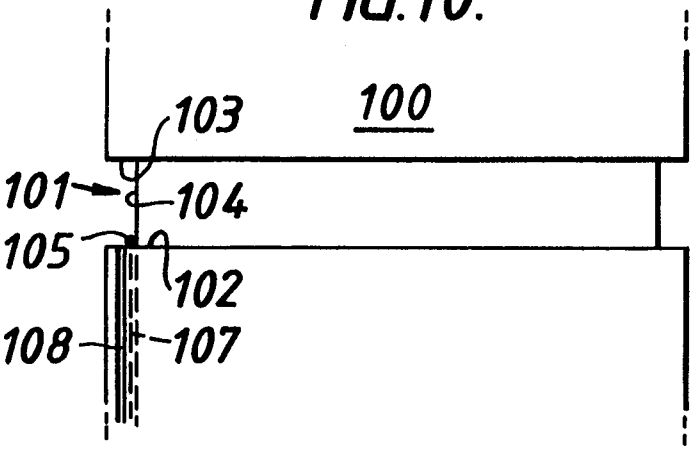
FIG. 10 is a view of the device in FIG. 9 taken in the direction of arrow X.

By way of schematic illustration, the grooved or recessed embodiments of probe may be in the forms shown in FIGS. 9 and 10, and 11.

In FIGS. 9 and 10, the outside or periphery of the probe 100 is provided with axially spaced annular grooves, only one of which 101 is shown for simplicity. Each groove has a lower surface portion 102, an upper surface portion 103 and an inner surface portion 104. Each groove accommodates on its lower surface portion 102 a thermojunction 105 and the thermojunctions 105 in successive grooves are situated in positions which are peripherally displaced or offset from each other. The tracks 106 and 107 extend from the thermojunction 105 to the periphery of the probe 100 at its junction with the lower surface portion 102 of the groove 101 and then down the outside of the probe to the 'cold' thermojunctions electrically preceding and succeeding the thermojunction 105. In the process the tracks 106 and 107 negotiate the surface portions 103, 104, 102 of any lower grooves 101 (not shown). Alternatively, and as shown, the tracks 106 and 107 are located within and extend down channels 108 extending longitudinally of the probe between the annular grooves 101. Advantageously, the depth of the channels 108 is substantially the same as the depth of the grooves 101. The channel arrangement provides for better physical protection of the tracks and relative ease of manufacture.

In another form of probe as shown in FIG. 11, axially spaced recesses are offset from each other around the periphery of the probe. Each recess, only one of which is shown in FIG. 11, is of part-spiral form 110 wherein the depth of the recess in a radial direction with respect to the probe axis (that is the distance from the inner surface portion 111 to the outer edge 113 of the lower surface portion 112) increases in a circumferential direction from a region 114 where the inner portion 111, lower surface portion 112 and upper surface portion 115 of the recess all merge with the peripheral surface of the probe, to a region 116 of maximum depth where the recess terminates at an end surface 117 which extends between the upper and lower surface portions 115, 112 and to the inner surface portion 111. In this case the inner surface portion 111 provides the base for a smooth lead in/out of the tracks 118 and 199 to or from the thermojunction 120.

Most advantageously the surface portions 103 and 104 of the grooves 101 and also the surface portions 111 and 115 and the end surface 117 of the recesses 110 may be provided with a low-emissivity coating to further reduce the amount of radiant heat retained by the thermojunctions 105 or 120.

The thermojunctions and the tracks are overglazed for protection.

The low-emissivity coating and overglaze may be applied separately or, alternatively, may be provided in a single combined layer.

As before, for a given probe, flamestrip and burner apparatus prior experiments and investigations would be conducted to correlate the magnitude of the voltage output signal from the probe with the port loadings and the aerations used to produce the results.

Figure 12:
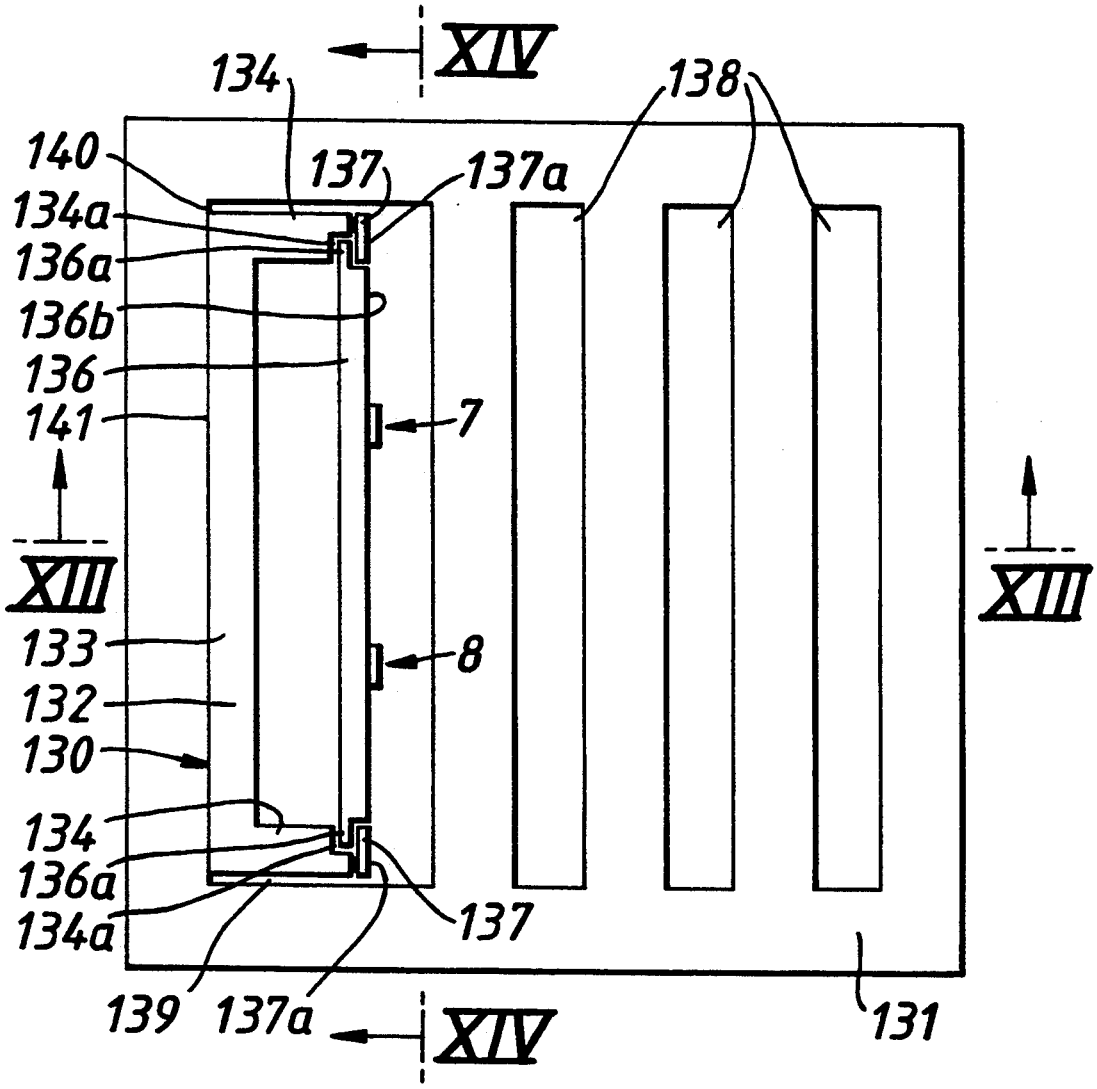
FIG. 12 shows in somewhat schematic form a plan view of yet another embodiment of thermoelectric device shown fixed in position to a flamestrip.
Figure 13:
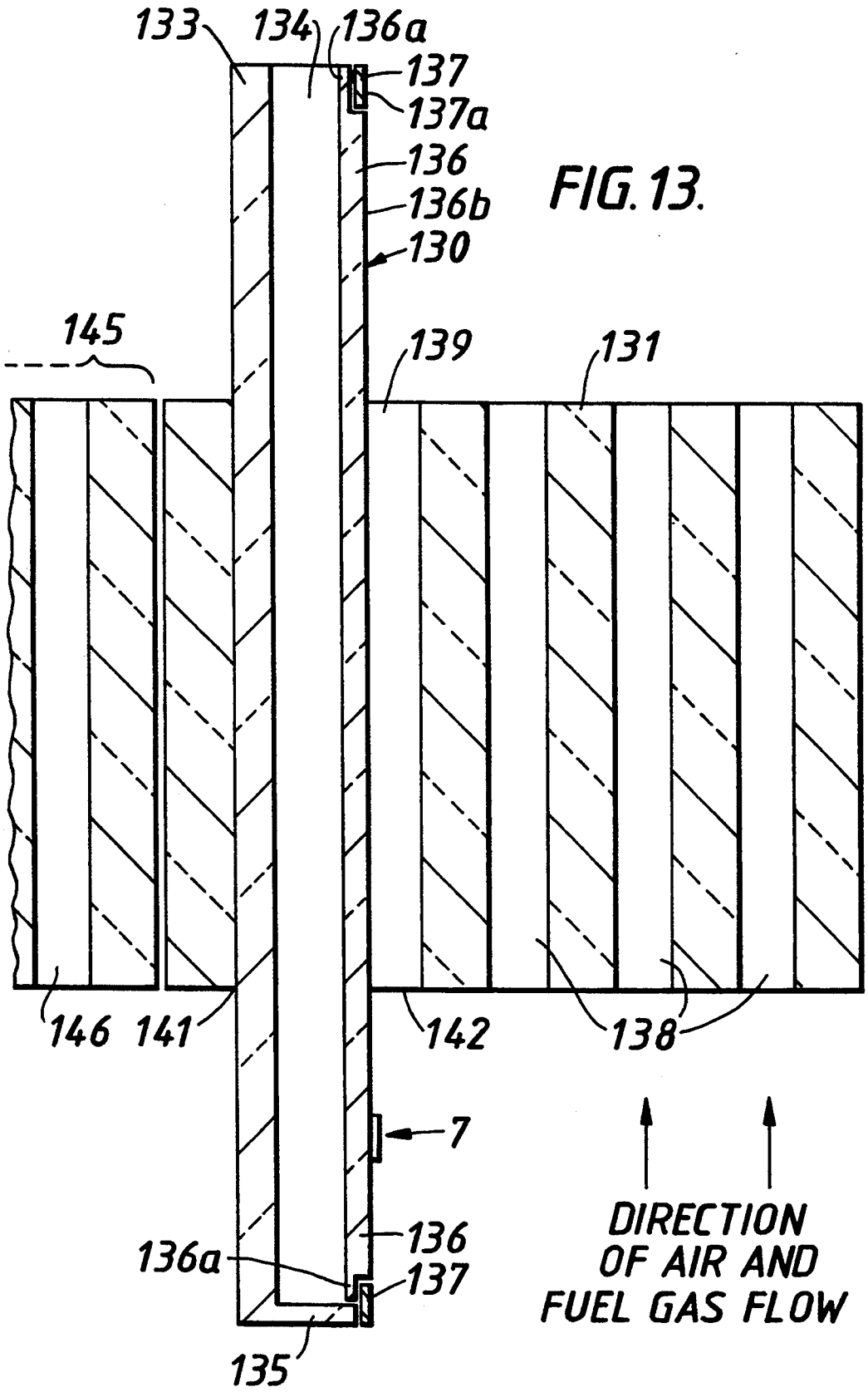
FIG. 13 is a cross-sectional view of the combination of the device and flamestrip, taken on the line XIII—XIII in FIG. 12.
Figure 14:
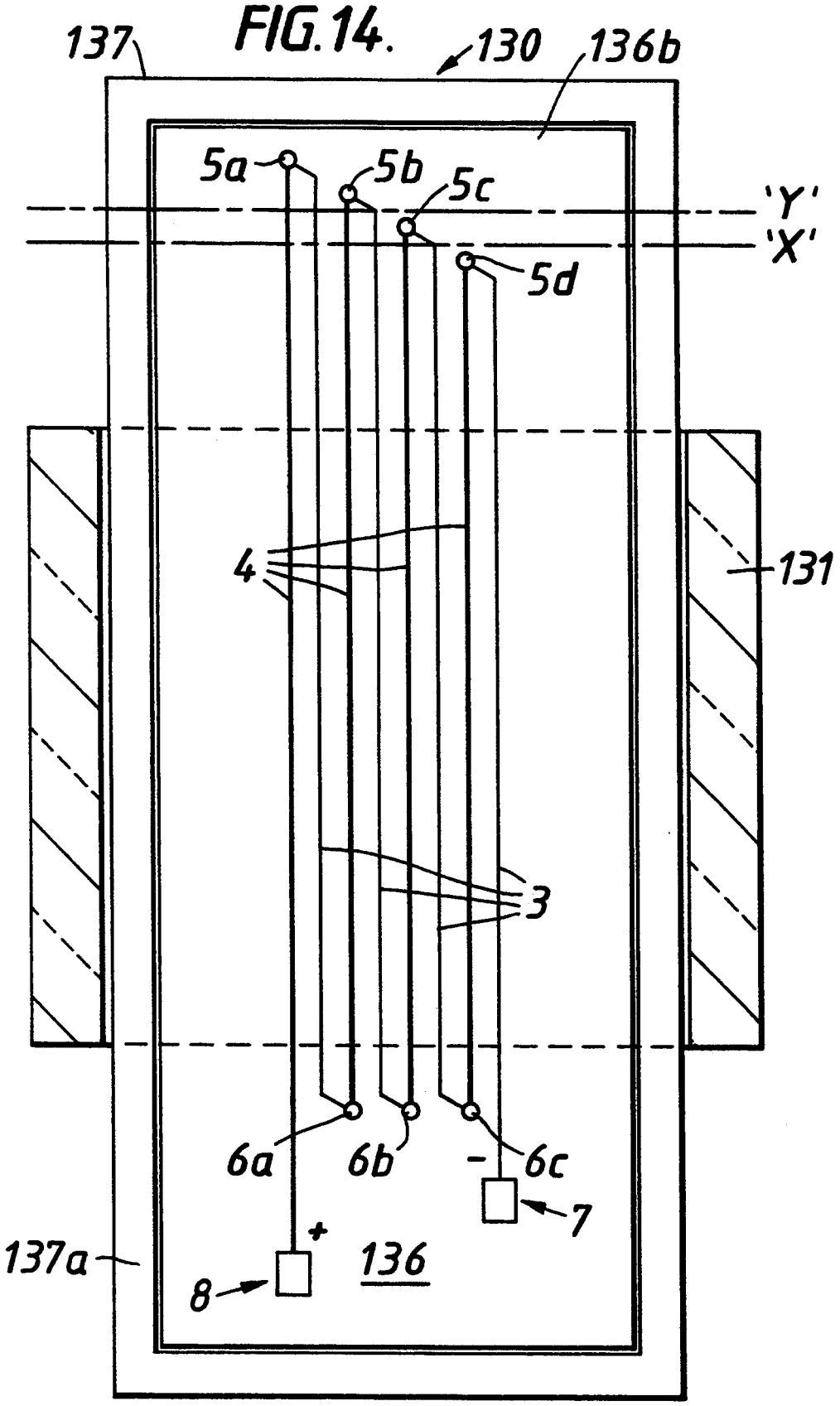
FIG. 14 is a cross-sectional view taken on the line XIV—XIV in FIG. 12.

FIGS. 12 to 14 illustrate somewhat schematically another embodiment 130 of thermoelectric device shown fixed to and forming a combination with a flamestrip 131.

The thermoelectric device 130 comprises a channel member 132 which as viewed in the Figures is open at the upper end, and has a bottom or rear wall 133, side walls 134, and a lower end wall 135. A thin flat or planar rigid strip 136 of ceramic material and having a peripheral edge portion 136*a* of reduced thickness is held between the free ends of the channel member walls 134 and 135 and a frame 137 which is fixed to the free ends of such walls. As can be seen from FIGS. 12 and 13 the free ends of the walls 134 have rebate portions 134*a* which accommodate the reduced thickness portions 136*a* of the strip 136 with the outer face 137*a* of the frame 137 being substantially flush with the outer facing surface 136*b* of the strip 136.

The strip 136 is thus held securely but freely between the channel member 132 and the frame 137 so as to substantially avoid stresses which might otherwise occur due to differential rates of expansion and contraction between, on the one hand, the strip 136 and, on the other hand, the channel member 132 and frame 137.

The flamestrip 131 comprises a plurality of similar burner ports 138 and an opening 139 which is of greater width than the ports 138 and through which the assembled device extends. The device is secured in a predetermined position by fixing the outside surface of the rear wall 133 of the channel member to the bounding wall 140 of the opening 139, for example by thermal bonding as indicated at 141.

The front of the ceramic strip 136 defines with the opposing bounding wall of the opening 139, an aperture 142 through which the mixture of fuel gas and air is passed and which supports a flame having a predetermined relationship to that supported by each of the plurality of ports 138.

The construction, arrangement and function of the upper thermojunctions 5*a,b,c,d* and the lower thermojunctions 6*a,b,c* are similar to those as described above with respect to FIG. 1. However, in this embodiment all of the thermojunctions are on the outwardly facing surface 136*b* of the planar ceramic strip 136.

Alternate tracks of alumel 3 and chromel 4 are joined together to form the thermojunctions 5*a,b,c,d* and 6*a,b,c* as can be appreciated from FIG. 14. In effect the thermojunctions of the two different sets are electrically connected together, alternatively, in series. The alumel track 3 from the thermojunction 5*d* and the chromel track 4 from the thermojunction 5*a* extend down the strip 136 and are connected with electrical terminal regions 7,8, respectively, via which voltage output signals are passed from the device 130.

The distance over which the thermojunctions 5*a,b,c,d* are spaced laterally on surface 136*b* is, on the one hand, substantially less than the length of the aperture 142 and is, on the other hand, such that the thermojunctions 5*a,b,c,d* are sufficiently spaced apart laterally to minimise the conduction of heat between the thermojunctions through the ceramic strip 136. The provision of a ceramic strip 136 which is thin and the existence of the hollow 143 within the assembly of the channel member 132, strip 136 and the frame 137 reduces the thermal capacity of the device and minimises unwanted transfer of heat from the assembly to the thermojunctions 5*a,b,c,d*. With the arrangement in this embodiment, the thermojunctions 5*a,b,c,d* are positioned so as to sense temperature emanating from a flamefront supported only by the flamestrip 131. The combination of the flamestrip 131 and the thermoelectric device 130 may be positioned next to another flamestrip 145 provided with burner ports 146 and located at the side of the device 130 remote from the ceramic strip 136, as indicated in FIG. 13, to provide means to facilitate burner control in respect of the total flamestrip region.

Figure 15:
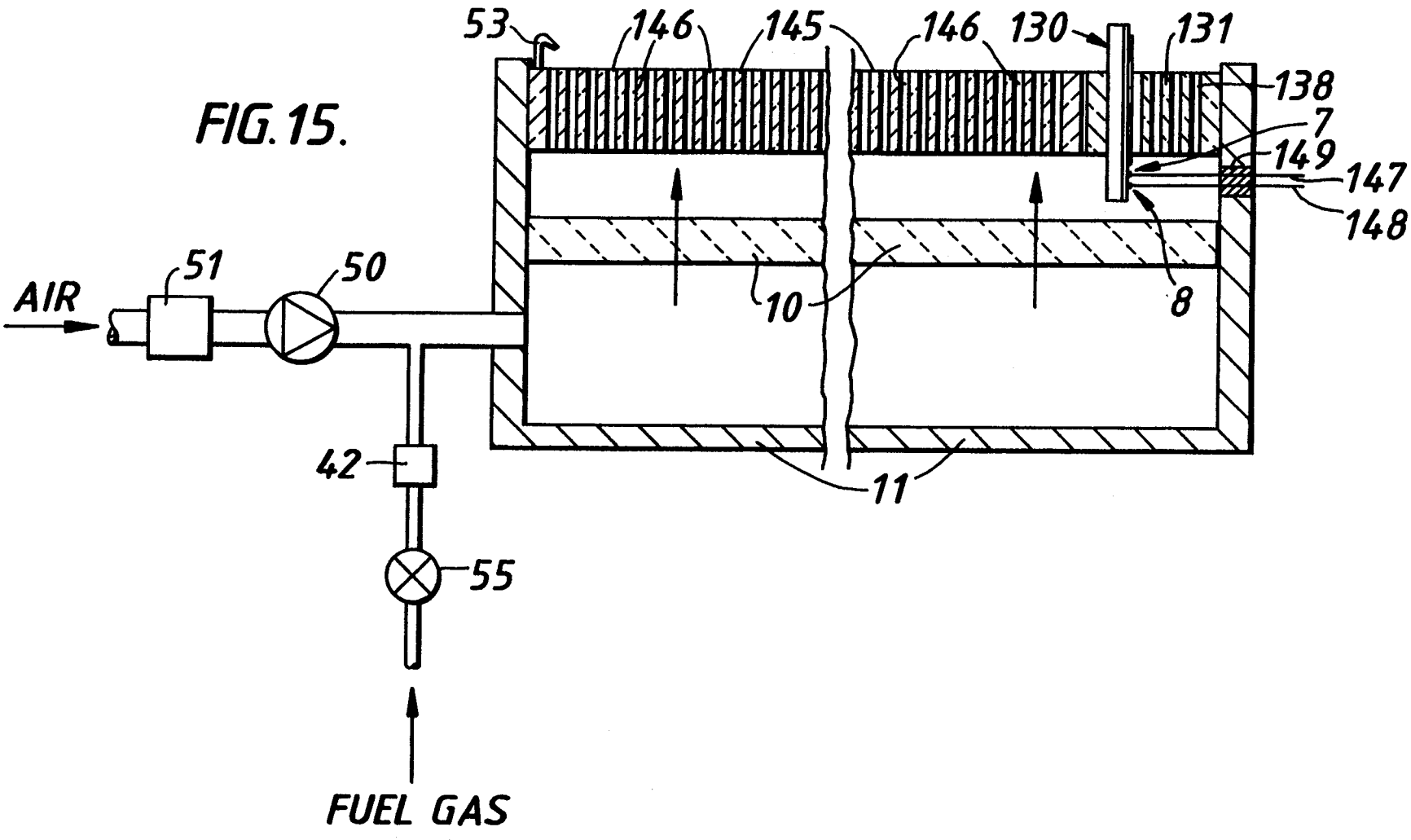
FIG. 15 is a schematic view of a burner apparatus incorporating a combination of device and flamestrip illustrated in FIG. 13.

The burner apparatus shown schematically in FIG. 15 includes parts which are equivalent to parts which have already been identified in FIGS. 1, 8 and 13, and such parts in FIG. 15 have been allotted the same reference numbers as before. The burner apparatus in FIG. 15 is of the fully premixed air/fuel gas burner kind and comprises the combination of the flamestrip 131 and the thermoelectric device 130 and the flamestrip 145 next to which the flamestrip 131 is positioned. In effect the two flamestrips 131 and 145 serve as flamestrip parts which together provide an overall flamestrip. The ignition means 53 is provided near the end of the flamestrip 145 remote from the flamestrip 131. A permeable flametrap 10 is spaced below the upstream faces of the flamestrips 131 and 145. Below the flametrap is wall 11 of a plenum chamber. The air/fuel gas premixture is fed into the plenum chamber for supply to the flamestrips 131 and 145, with the air being delivered by the variable-speed combustion air fan 50 and the fuel gas being delivered via the modulating gas valve 55. It should be appreciated that the burner apparatus of FIG. 15 should be considered as incorporating, and understood in conjunction with, the control system of FIG. 8, with the thermoelectric device 130 replacing the probe 1. In FIG. 15, the air flowrate detecting means 51 only is shown associated with the fan means 50, and the gas flowrate detecting means 42 only is shown associated with the gas valve 55; it being understood that the apparatus functions substantially in accordance with the description relating to the functioning of the control system in FIG. 8.

Electrical conducting leads 147 and 148, protected by high temperature sleeving, are secured to the electrical terminal regions 7 and 8, respectively, and pass through sealing means 149 in a surrounding wall of the burner apparatus to the signal processing means 45,46,47 and 48 as in FIG. 8 but not shown in FIG. 15.

When the burner apparatus is operating, as indicated earlier in relation to FIG. 13, the thermoelectric sensors 5*a,b,c,d* sense temperature emanating from a flame front of a flame supported by the flamestrip 131 but not emanating from the flamestrip 145. For reasons mentioned earlier, the flamestrip 131 is operated under "non-radiating" conditions, while the flamestrip 145 may be used under either radiating or "non-radiating" conditions.

To reduce the amount of radiant heat retained by the thermojunctions 5*a,b,c,d* should any radiant heat reach them, the surface 136*b* of the ceramic strip 136 may be provided with a low emissivity coating.

The thermojunctions and the tracks may be overglazed for protection.

The low-emissivity coating and overglaze may be applied separately or, alternatively, may be provided in a single combined layer.

In a burner apparatus as described above using a relatively small flamestrip combined with a thermoelectric device according to the invention, in conjunction with one or more relatively large flamestrips, the response of the device is dependent only on the nature of the burner flame associated with the relatively small flamestrip. It will be appreciated that the control system responds to the output signals from the device and controls the burner, including the control of the aeration of the flame supported by the relatively large flamestrip(s) as well as that of the relatively small flamestrip of the burner.

Another embodiment of thermoelectric device (not shown) comprises a thermoelectric arrangement in which one or more 'hot' thermojunctions is/are at a similar predetermined distance upstream of the flamestrip as the thermojunctions 6*a,b,c*. 'Cold' thermojunctions in the present embodiment would be located upstream of the 'hot' junctions, for example in the region adjacent the upstream side of the flametrap 10. Under normal firing conditions the thermoelectric device produces an output signal of a magnitude less than the magnitude of a predetermined reference signal with which comparator means (not shown) would compare the output signal. However, when lightback occurs at the upstream side of the flamestrip 9, such lightback is detected or sensed as a result of it causing the output signal from the device to exceed the reference signal. In response to this detection, control means (not shown) may be arranged to effect 'lockout' of the burner apparatus as described previously. It will be appreciated that in this embodiment no provision is made for the monitoring of aeration or of flame establishment/failure.

A further embodiment of thermoelectric device (also not shown) may comprise a modification of, and an addition to, the device shown in FIG. 1. Thus, the thermojunction arrangement may be similar to that shown except that the 'cold' junctions 6*a,b,c* would not be employed to detect lightback and would be located further upstream under substantially single temperature conditions, for example in the region adjacent the upstream side of the flame trap. Lightback would be detected by a completely separate thermojunction arrangement embodied into the device construction in a similar fashion to the tracks 3,4 and 'hot' and 'cold' junctions 5*a,b,c,d* and 6*a,b,c* in FIG. 1 respectively. This separate thermojunction arrangement incorporated into the device would comprise one or more 'hot' junction(s) at a predetermined distance upstream of the flamestrip, for example at the position occupied by the 'cold' thermojunctions 6*a,b,c* between the flamestrip and the flametrap as viewed in FIG. 1, whilst the 'cold' thermojunction(s) of the separate thermojunction arrangement would be located upstream of the downstream side of the flametrap. The output voltage signal from the separate lightback detection arrangement would be sensed independently via separate terminals at the base of the device. It will therefore be appreciated that in this embodiment one thermojunction arrangement produces a signal for use in the monitoring and control of the burner aeration and optionally also for monitoring flame establishment/failure, whilst another completely separate thermojunction arrangement produces a signal for monitoring the occurrence, or not, of lightback.

The Applicants believe that the above described device overcomes various disadvantages associated with known platinum resistance temperature sensor arrangements. When there is a partial but not complete break of a connection in the platinum resistance sensor arrangement an erroneous output may occur as a result of an increase in resistance accompanying the partial break. Were it not for the breakage an increase in sensor resistance would signify an increase in temperature, which, were such a device used to monitor the aeration in a combustion control system, would imply a reduction in aeration. Consequently the control system would, wrongly, cause the rate of air supply to be increased, possibly to the point of inducing a complete loss of flame due to lift, as described earlier.

With the Applicants device described above the overglaze protects the thermocouple tracks and junctions to a certain extent and should a partial breakage occur in, say, one of the tracks, the output signal is not affected since the generation of output voltage from the device is not reliant upon a flow of current through the thermojunctions or tracks. A substantially complete breakage would be required to affect the output, and such a loss of path continuity may be detected readily by signal processing means. The possibility of rupture of the tracks 3,4 is minimised by ensuring that the coefficient of thermal expansion of the thermoelectric materials forming the tracks and the junctions 5*a,b,c,d* and 6*a,b,c* approximates to that of the material on which such tracks and junctions are formed.

Various other kinds of aeration sensors, for example solid-state oxygen sensors, can fail at least in accuracy, for example as a result of contamination which causes the output to depart from the value normally expected under the prevailing conditions.

Applicants investigations have shown that, advantageously, combustion resonance noise and NOx emission from fully premixed air/fuel gas burners can be kept at low levels when the aeration of the flame supported by the flame plate or strip is maintained at a high level, for example greater than 140%, but however not at such a high level, for example 160%, as to cause flame lift. The use of the above described device facilitates close control of the aeration to the required level.

I claim:

1. A thermoelectric sensing device for use in a fully premixed air/fuel gas burner apparatus comprising a flamestrip through which premixed air and fuel gas can pass for combustion in the vicinity of a downstream side of the flamestrip relative to the intended direction of flow of the premixture through the strip, the device comprising:

an elongate supporting body;

a plurality of temperature sensors on said supporting body and comprising discrete thermojunctions which define "hot" junctions and which are electrically connected alternately in series with at least one further discrete thermojunction, the at least one further discrete thermojunction serving as a "cold" junction, wherein when the device is located in said gas burner apparatus and in position with respect to the flamestrip, the "hot" junctions are at different predetermined distances downstream of an upstream side of the flamestrip, the individual "hot" junctions being so dimensioned and spaced from each other as to generate an aggregate output voltage which changes in a generally step-like manner as the flamefront of a flame supported by the flamestrip moves over the region occupied by the plurality of the "hot" junctions and successively across the "hot" junctions, with relatively large changes in the voltage output occurring as the flamefront crosses each "hot" junction and with the voltage output remaining at a relatively constant value as the flamefront moves across the region, between successive "hot" junctions, and wherein each of the at least one "cold" junctions is spaced from all of the "hot" junctions in the longitudinal direction of the elongate body and upstream of the flamestrip; and conducting means via which voltage output signals emanating from the junctions can be sensed.

2. A device as claimed in claim 1, in which, when the device is located in position with respect to the flamestrip, at least one of the "hot" junctions is upstream of a downstream side of the flamestrip.

3. A device as claimed in claim 1, in which, when the device is located in position with respect to the flamestrip, all of the "hot" junctions are downstream of a downstream side of the flamestrip.

4. A device as claimed in any of the preceding claims 1–3, in which, when the device is located in position with respect to the flamestrip, any "hot" junction downstream of a downstream face of the flamestrip is shielded by a physical barrier from a direct line of sight to a source of radiant heat.

5. A device as claimed in claim 4, in which, when the device is located in position with respect to the flamestrip, each "hot" junction downstream of the downstream face of the flamestrip is located within a recess provided in the device.

6. A device as claimed in any one of claims 1 to 3, including a physical barrier means which shields each said "hot" junction from a direct line of sight to another said "hot" junction.

7. A device as claimed in any of claims 1 to 3, in which the device has a planar surface on which the "hot" junctions are provided.

8. A device as claimed in claim 7, in which the device is of flat or planar form providing two planar surfaces.

9. A device as claimed in claim 8, in which all the junctions are on the same planar surface.

10. A device as claimed in any of claims 1 to 3, in which the device includes a hollow cylindrical or prismatic body portion having a peripheral surface on which the temperature sensors are provided.

11. A device as claimed in any of the preceding claims, in which the at least one "cold" junction can sense increased temperature upstream of the flamestrip, as a result of flame lightback occurring through the flamestrip and in response thereto to generate a voltage output which can be sensed via said conducting means.

12. A fully premixed air/fuel gas burner apparatus comprising:

a flamestrip through which premixed air and fuel gas can pass for combustion in the vicinity of a downstream side of the flamestrip relative to the intended direction of flow of the premixture through the strip;

a thermoelectric sensing device located in position with respect to the flamestrip, the device comprising an elongate supporting body;

a plurality of temperature sensors on said supporting body and comprising discrete thermojunctions which define "hot" junctions and which are electrically connected alternately in series with at least one further discrete thermojunction, the at least one discrete further thermojunction serving as a "cold" junction, wherein the "hot" junctions are at different predetermined distances downstream of an upstream side of the flamestrip, the individual "hot" junctions being so dimensioned and spaced from each other as to generate an aggregate voltage output which changes in a generally step-like manner as the flamefront of a flame supported by the flamestrip moves over the region occupied by the plurality of the "hot" junctions and successively across the "hot" junctions, with relatively large changes in the voltage output occurring as the flamefront crosses each "hot" junction and with the voltage output remaining at a relatively constant value as the flamefront moves across the region between successive "hot" junctions, and wherein each of the at least one "cold" junctions is at a position spaced from all of the "hot" junctions in the longitudinal direction of the elongate body and upstream of the flamestrip;

conducting means via which voltage output signals emanating from the junctions can be sensed; and signal processing means responsive to the voltage output signals for controlling the burner apparatus.

13. A burner apparatus as claimed in claim 12, in which the at least one "cold" junction can sense increased temperature upstream of the flamestrip, as a result of flame lightback occurring through the flamestrip, and generate a voltage output in response thereto, wherein said signal processing means is responsive to signals corresponding to the voltage output from said at least one "cold junction for indicating flame lightback through the flamestrip.

14. A burner apparatus as claimed in claims 12 or 13, in which the device is fixed to the flamestrip.

15. A burner apparatus as claimed in claim 14, in which the device is fixed to a peripheral edge of the flamestrip.

16. A burner apparatus as claimed in claim 14, in which the device extends through the flamestrip.

17. A burner apparatus as claimed in claim 12 or claim 13, in which the device is in the form of a probe which extends through an aperture in the flamestrip.

18. A burner apparatus as claimed in claim 12 or 15, in which the flamestrip at least in part defines at least one opening adjacent the outer surface of the device, such that when the burner is in use the at least one opening serves to support a flame having a predetermined relationship to that supported by the remainder of the flamestrip.

19. A burner apparatus as claimed in any of claims 14 or 13, in which the flamestrip comprises a first flamestrip zone and a second flamestrip zone with the "hot" junctions of the device being arranged so as to sense temperature emanating from the flame front of a flame supported only by the first flamestrip zone.

20. A burner apparatus as claimed in claim 14, in which the first and second zones are discrete first and second parts, respectively.

21. A burner apparatus as claimed in claim 12, including a fan supplying air to said burner apparatus, wherein said signal processing means comprise means for controlling said fan so as to control flame aeration.

22. A burner apparatus as claimed in claim 12 or 21 including a gas valve regulating a supply of fuel gas to said burner apparatus, wherein said signal processing means comprise means for controlling said gas valve so as to control flame aeration.

23. A burner apparatus as claimed in claim 22, wherein said signal processing means comprise means for indicating flame establishment near the flamestrip.

24. A burner apparatus as claimed in claim 22, wherein said signal processing means comprise means for indicating flame loss near the flamestrip.

25. A combination of a thermoelectric sensing device and a flamestrip for use in a fully premixed air/fuel gas burner apparatus, through which flamestrip, when in use, premixed air and fuel gas can pass for combustion in the vicinity of a downstream side of the flamestrip; and wherein the device is fixed or secured to the flamestrip and comprises:

an elongate supporting body;

a plurality of temperature sensors comprising discrete thermojunctions defining "hot" junctions electrically connected alternately in series with at least one further discrete thermojunction, the at least one further discrete thermojunction defining a "cold" junction, wherein the "hot" junctions are at different predetermined distances downstream of an upstream side of the flamestrip, the individual "hot" junctions being so dimensioned and spaced from each other as to generate an aggregate voltage output which changes in a generally steplike manner as the flamefront of a flame supported by the flamestrip moves over the region occupied by the plurality of the "hot" junctions and successively across the "hot" junctions, with relatively large changes in the voltage output occurring as the flamefront crosses each "hot" junction and with the voltage output remaining at a relatively constant value as the flamefront moves across the region between successive "hot" junctions, and wherein the at least one "cold" junction is at a position spaced from all of the "hot" junctions in the longitudinal direction of the elongate body and upstream of the flamestrip; and conducting means via which voltage output signals emanating from the junctions can be sensed.

26. A combination as claimed in claim 25, in which the at least one "cold" junction can sense increased temperature upstream of the flamestrip as a result of flame lightback occurring through the flamestrip and generate a voltage output in response thereto.

* * * * *